United States Patent [19]

Houck

[11] 3,945,107

[45] Mar. 23, 1976

[54] PROCESS OF ERECTING VERTICAL RISING MAST

[75] Inventor: Theodore B. Houck, Tulsa, Okla.

[73] Assignee: Parker Drilling Company, Tulsa, Okla.

[22] Filed: Dec. 17, 1973

[21] Appl. No.: 425,146

[52] U.S. Cl. ..... 29/431; 52/741; 52/120; 52/121; 52/123

[51] Int. Cl.[2] .....E04G 21/00; E04G 23/06; B21D 39/03; B23P 11/00

[58] Field of Search ..... 173/151; 52/116, 121, 122, 52/123, 40, 741, 637, 638; 29/430, 431, 155 C, 467, 468; 182/187; 220/1 B; 212/57

[56] References Cited

UNITED STATES PATENTS

| | | | |
|---|---|---|---|
| 1,360,131 | 11/1920 | Miller | 52/123 |
| 1,375,092 | 4/1921 | Hansen | 173/151 |
| 1,539,109 | 5/1925 | Bramdt | 52/123 |
| 1,605,472 | 11/1926 | Schick | 52/121 |
| 1,644,499 | 10/1927 | Trout | 52/121 |
| 2,299,383 | 10/1942 | Crow | 52/40 |
| 2,720,694 | 10/1955 | Hines | 182/187 |
| 2,857,026 | 10/1958 | Jones | 52/123 |
| 3,672,115 | 6/1972 | Abe et al. | 52/40 |

*Primary Examiner*—Frank L. Abbott
*Assistant Examiner*—James L. Ridgill, Jr.
*Attorney, Agent, or Firm*—Head & Johnson

[57] ABSTRACT

This disclosure describes a drilling mast system which is adapted to be assembled section by section in a vertical position, as distinguished from the conventional method of raising a drilling mast by assemblying the mast in a horizontal position on the ground and then lifting the mast into a vertical position. The mast is made of a base section and a plurality of upper sections, each one adapted to be mounted on top of the one below it and fastened thereto. After the base section has been assembled on the foundation, the succeeding sections are assembled on the ground or are lifted in pieces and assembled in place on top of the previous section by means of a floating gin pole. The gin pole is supported inside of the mast by means of a plurality of basket cables.

The sections of the mast are made of rectangular horizontal cross section. The floating gin pole extends above the top of the topmost assembled section, and can tilt to the outside of the mast, so as to lift section parts outside the mast. After the top of the mast is completed a jib boom, or auxiliary support and block means, is mounted on the top section and used as a means to lower the floating gin pole to the ground. The auxiliary support means is then used to assemble the crown block on top of the mast. The jib boom is mounted on the top section and used as a means to lower the floating gin pole to the ground. The auxiliary support means is then used to assemble the crown block on top of the mast. The jib boom stays in place during the drilling operation and is used to lift the gin pole back into position when the mast is to be disassembled.

6 Claims, 5 Drawing Figures

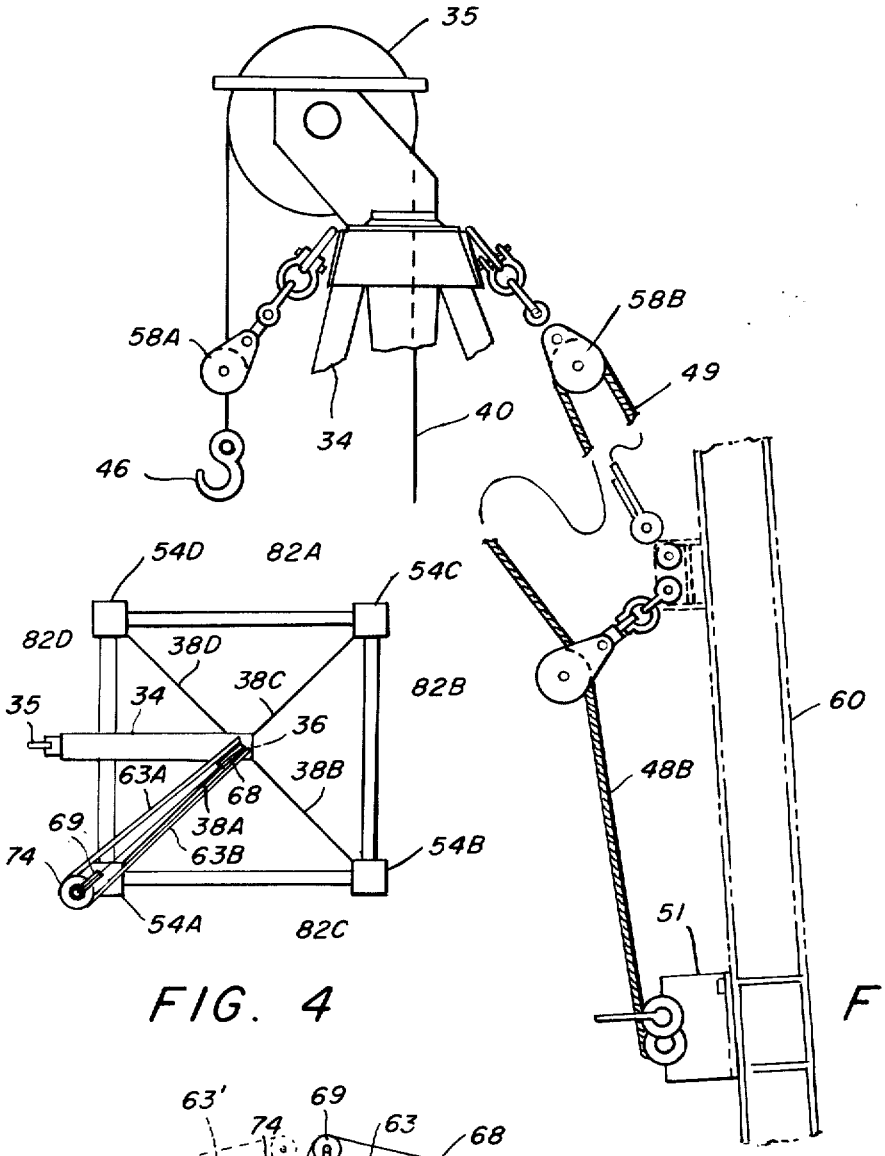
FIG. 4
FIG. 3
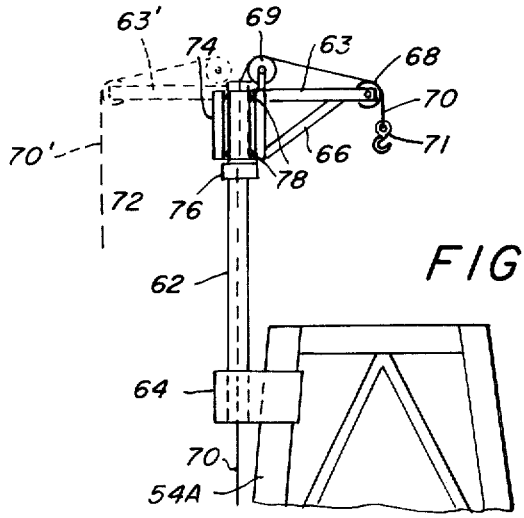
FIG. 5

PROCESS OF ERECTING VERTICAL RISING MAST

BACKGROUND OF THE INVENTION

This invention lies in the field of high structural masts. More particularly, it is concerned with drilling masts used in the rotary drilling of deep bore holes. Still more particularly, it is concerned with a drilling mast which can be assembled in a vertical position, section by section.

In the prior art there are many types of structural masts that have been constructed for use in the oil and other industries, but most of these, if not all, are designed to be assembled on a level ground and then tilted into vertical position by lifting the top end of the mast.

This type of mast assembly requires a very long clear working area that is substantially horizontal and free of any obstacles such as trees and vegetation. In many areas of the world where drilling operations are carried on, such as in jungle or other heavily wooded areas, marshes, and other similar areas, where such clear horizontal space can be provided only at great expense, it is more convenient to transport the tower by sections or partial sections by means of helicopters into a cleared area only sufficiently large to assemble the mast in a vertical position. The problem is how to assemble the tall mast without the use of an auxiliary crane that has a boom longer than the total height of the drilling mast.

SUMMARY OF THE INVENTION

It is a primary object of this invention to provide an apparatus and a method of assembly by means of which a tall structural drilling mast can be assembled section by section in a vertical position without the use of an auxiliary crane of great size.

This and other objects are realized and the limitations of the prior art are overcome in this invention by using a mast which is constructed of a plurality of separate structural sections which can be positioned one on top of the other and fastened to the ones below and above. The means of lifting comprises a floating gin pole which is supported inside of the tower, or mast, by means of a plurality of basket cables which are attached at one end to the bottom of the gin pole and attached at their other ends to a corresponding plurality of points on the top of the last previously positioned section. When the bottom end of the gin pole is supported in this way, luffing lines can be attached to the top end of the gin pole, and attached to small winches which are fastened to the top of the last previously positioned section, as the mast is being erected. Since the gin pole extends well above previously assembled section, it extends far enough to the side of the mast to pick up parts of the upper sections, which can be lifted into position on top of the previously assembled section and fastened to it.

As each section is added to the mast, the gin pole is lifted by one section, the basket lines being fastened to corresponding points on the section above. There are a plurality of jump lines which are attached to the newly added section near its top, by means of which the base end of the floating gin pole can be lifted so that the basket lines can be moved to their corresponding positions on the newly added section. Then, after another new section is added, the base of the floating gin pole is again lifted and the basket lines moved up another section and so on. In this manner each of the sections in turn can be added to those already in place, until the mast is completely assembled. The remaining step is to remove the floating gin pole from the structure.

The means for removing the gin pole is to lift and position on the top of the mast an auxiliary support and block means. This can be a conventional jib boom, by means of which the lifting cable and winch can be used to lift the gin pole, so that the basket cables can be removed and the gin pole can then be lowered to the ground down through the inside of the mast. The jib boom is then used to assemble the crown assembly and the crown block on top of the top section of the mast. Thereafter the jib boom stays in place while the drilling is carried out.

BRIEF DESCRIPTION OF THE DRAWINGS

These and other objects and advantages of this invention and a better understanding of the principles and details of the invention will be evident from the following description taken in conjunction with the appended drawings in which:

FIG. 3 illustrates the method of controlling the top end of the floating gin pole by means of the luffing lines and winch.

FIG. 4 illustrates the plan view of a section and the manner of supporting the bottom end of the gin pole by means of the basket cables.

FIG. 5 shows an auxiliary support and block means, or jib boom, fastened to the top section of the mast for lowering the floating gin pole.

DESCRIPTION OF THE PREFERRED EMBODIMENT

Figure 1:
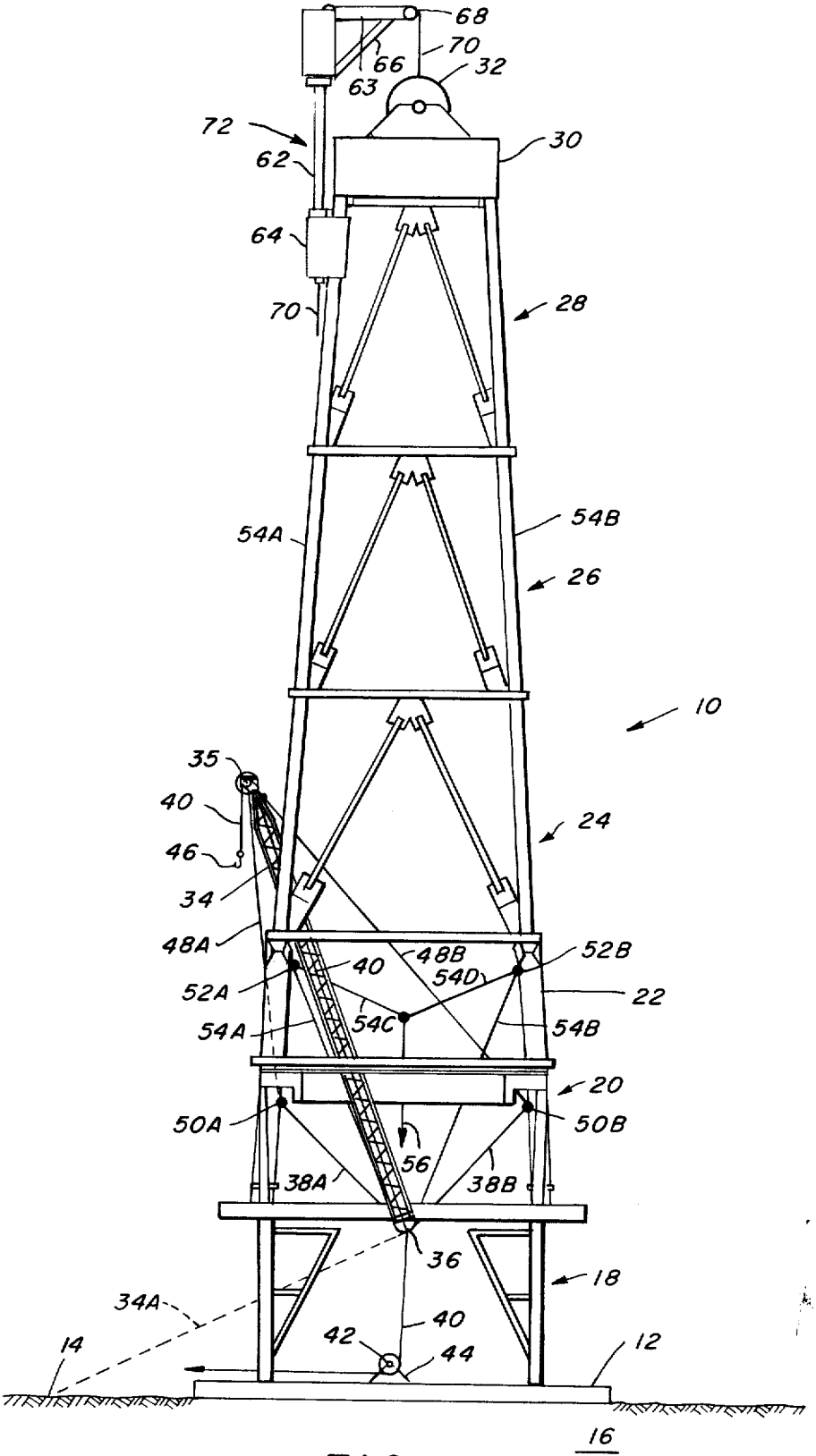
FIG. 1 illustrates in side view a view of the assembled mast including the floating gin pole and the auxiliary gin pole.
Figure 2:
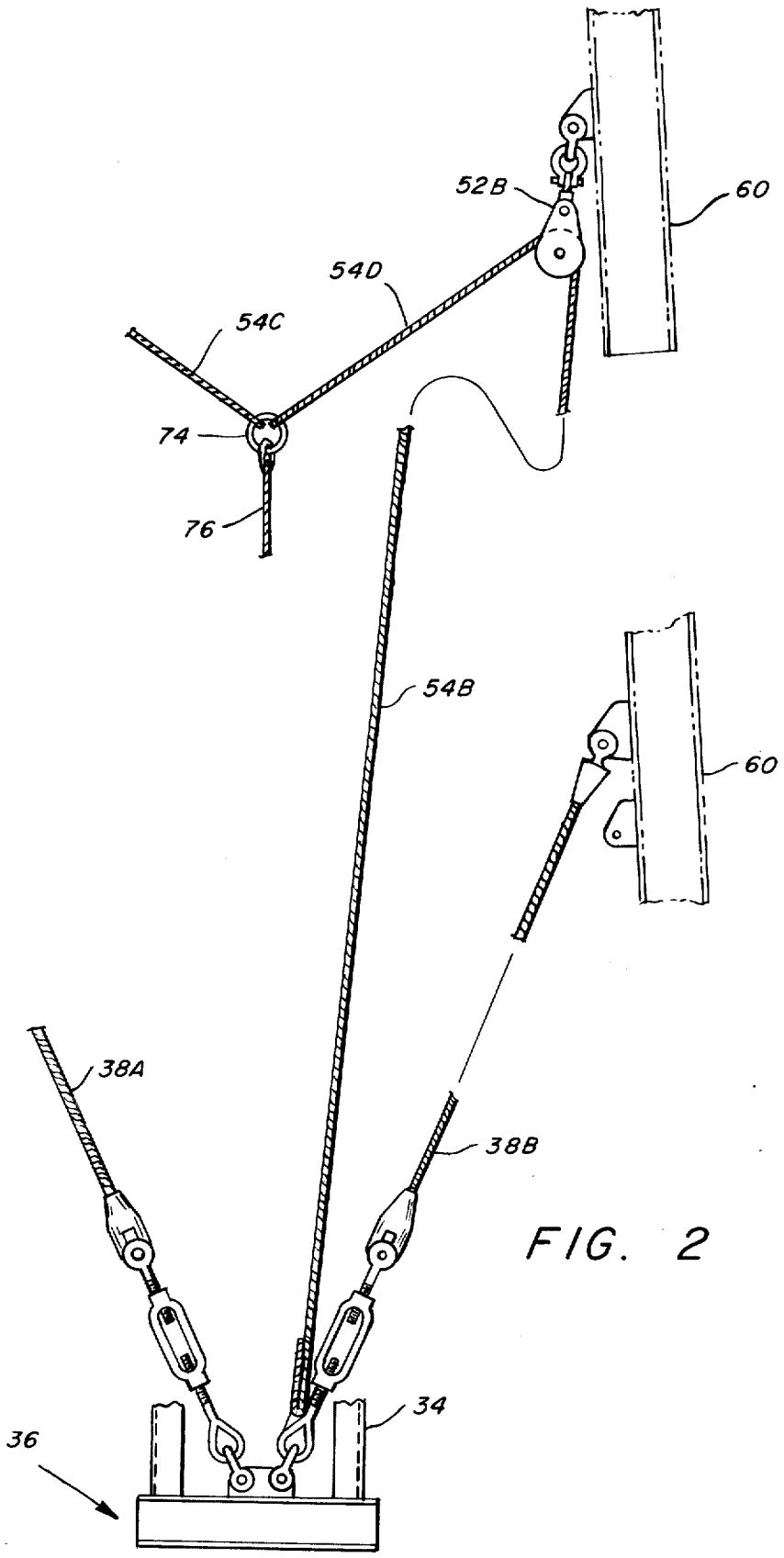
FIG. 2 represents some details of the base of the gin pole, the basket cables and the jump lines for lifting the bottom end of the gin pole.

Referring now to the drawings there is shown in FIG. 1 a view of the completed mast. The lower or base section of which is identified by the numerals 18 and 20. This can be assembled on the foundation 12, which rests on the earth 16, by means of a small crane. As shown in FIG. 4, the mast is made in the form of a rectangular cross section with four main corner columns 54A, 54B, 54C, and 54D. There are structural support means on three of the faces of the section, but there is no cross support means between the corner column supports 54A and 54D of the lower sections, although the upper sections are completely closed. A suitable sling for each of the sections, or parts of the sections, is provided so that they can be lifted by a support cable over the gin pole block. The floating gin pole can then be raised to a vertical position, along the axis of the mast, and the new section, or part section, lowered until it is supported by the structure already assembled.

Consider that the base sections 18 and 20 are preassembled on the ground 14. The floating gin pole is then positioned on the ground with its lower end at the axis of the mast. The basket cables 38A, 38B, etc. are attached to the support columns of the mast at points 50A, 50B, etc. Next, jump lines, such as 54A, 54B are attached through snatch blocks positioned at points 50A, 50B, etc. such that by pulling down on cable 56 by means of the principal winch line 40, the lower end of the floating gin pole can be lifted so that the cables 38A and 38B can be attached to the lower end of the gin pole. Then, by releasing the pull on the cable 56, the gin pole is lowered until it is supported solely by the basket cables 38A and 38B, etc.

In the assembly of the first section 22 the snatch blocks would be positioned at the points 50A and 50B so that the bottom of the gin pole could be lifted off the ground and high enough so that the cables 38A and 38B etc. can be connected. The gin pole is then in a position shown by the dashed line 34A.

Once the gin pole is attached to the basket cables, luffing lines such as 48A and 48B are attached to winches 51 as shown in FIG. 3, at the points 50A and 50B. By means of the luffing lines, the top end of the floating gin pole can be raised to the position shown. The main lifting line 40 is attached to a winch (not shown) and is threaded through an anchor block 42 up through the center of the gin pole 34 and along the axis of the gin pole to the top end and over the block 35 so that it can support a lifting hook 46. By suitably controlling the position of the upper end of the gin pole by means of the luffing lines 48A and 48B etc. the gin pole can be tilted so that its top end projects to the side of the mast as shown in FIG. 1, so as to pick up a new section or section subassembly, such as 22, for example, and lift it and move it over in position above the section 20 and then lower it on top of section 20, where it is then bolted into place by means not shown but well known. Once the section 22 is in place, then the snatch blocks for the jump lines are moved up to points 52A, 52B, etc. on the new section 22 and by means of the cable 56 the lower end 36 of the gin pole is lifted until the cables 38A and 38B can be attached to the points 52A and 52B, etc. so that the bottom of the gin pole will now be one section higher. Then the process of lifting a new section on top is repeated, until all of the sections have been added, and fastened together, including the crown section 30 and crown block 32.

It will be clear that a section can be built of two principal subassemblies comprising two columns such as 54C, and 54D, with cross braces 82A, and columns 54A, 54B with cross braces 82C, etc. Later the cross braces 82B and 82D can be added. This simplifies the lifting and positioning of the sections.

The mast is now ready for drilling. However, the gin pole is still in position inside of and near the top of the mast. The problem is to lower it to the ground, so that the inside of the mast will be free of any obstruction. An auxiliary jib boom 72 is raised by the floating gin pole 34 so that it can be fastened to the top section 28 by fastening means 64. The jib boom is made so that it can swivel, so that the horizontal arm 63 can be turned in position shown in FIG. 4 where the lifting line 70 is over the axis of the mast. A lifting cable 70 is passed through the block 68. The hook 71 is attached to the gin pole, and by means of the line 70 the gin pole is lifted, the basket cables 38A, 38B and jump lines 54A, 54B, etc. are removed, and the gin pole is lowered to the ground down along the axis of the mast to the rig floor where it is removed from the mast.

The auxiliary jib boom is then used to raise the crown assembly to the top of the mast. This operation must be done by the jib boom since the gin pole can not be used since it extends up inside the mast. The jib boom stays on the mast until the drilling operation is completed, and the mast is to be disassembled. At that time, the cable 70 is repositioned in the block 68, the crown assembly is removed and the gin pole is lifted into position along the axis of the mast. The basket lines and jump lines and luffing lines are again installed on the section below the top section so that the process of disassembling the mast from the top down, can begin.

The principal feature of this invention lies in the use of the auxiliary support and block means, or jib boom, 72, which is installed on the mast after the top section has been completed, so as to permit assembly of the crown block, and permit the lowering of the floating gin pole, prior to drilling operations, and for the purpose of raising the gin pole into position after the drilling operations are complete, so that the mast can be disassembled section by section.

The auxiliary support and block means 72 can be lifted into position and attached to the top section of the mast as shown in FIG. 5. The support, or jib boom 72, can be constructed of a rigid cylindrical column 62 supported at its lower end by bracket 64 to the corner column 54A. At the upper end there is a boom assembly composed of cylinder 74, arm 63 and brace 66. Bearings 78 are provided for free rotation. Sheaves 69, 68 are provided so that the lifting cable 70 can pass axially up the support 62 over sheaves 69, and 68 to lift the crown section or the gin pole.

While I have described the process as one of lifting preassembled sections, it will be clear that the sections can be lifted in the form of parts or sub assemblies, to the top of the last preassembled section, and fastened thereto and and to each other. Also, while I have described the winches which control the luffing lines raised as each section is added it will be clear that they can be provided with sufficient cable so that they can be mounted on a lower section, and simply the snatch blocks lifted. Also while I have described the cross section of the mast as rectangular, it is clear that any shape of cross section can be used. Also while the auxiliary support and block means is described as a jib boom, it can also be constructed in other forms.

While the invention has been described with a certain degree of particularity it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed:

1. In a vertical rising mast system including a base section, a plurality of intermediate sections and a top section, said top section of said mast having an overhanging and rotatable auxiliary support and block means, the method of assembling said mast comprising the steps of:

a. placing said base section on a suitable foundation;

b. supporting the bottom end of a floating gin pole by a plurality of basket lines from a plurality of points near the top of said base section;

c. laterally supporting the top of said gin pole by a plurality of luffing lines attached to a corresponding plurality of points near the top of said base section, said gin pole adapted to assume various angles with the vertical under control said luffing lines;

d. by means of said gin pole, positioning the first intermediate section on top of said base section;

e. raising said gin pole and attaching said basket lines and luffing lines to corresponding points on said first intermediate section;

f. repeating steps (d) and (e) until all intermediate sections and the top section have been positioned in their proper position;

g. positioning said auxiliary support and block means, on said top section; and h. using said auxiliary support and block means positioned on said top section, lowering said gin pole.

2. The method as in claim 1 including the additional step of using said auxiliary support and block means, positioning a crown assembly on top of the top section of said mast.

3. The method as in claim 1 in which said step of raising said gin pole comprises the steps of:

attaching a plurality of lifting lines to the bottom end of said gin pole; and lifting said lifting lines.

4. The method as in claim 1 in which said step of positioning said auxiliary support and block means comprises the steps of:

by means of said gin pole lifting said auxiliary support and block means and attaching the rotatable boom to one corner of the top section of the mast;

whereby said boom can be sequentially rotated to position said block means over the inside of said mast and over the outside of said mast.

5. The method as in claim 1 in which the step of supporting the bottom end of a floating gin pole by a plurality of basket lines includes the step of:

independently adjusting the length of each basket line.

6. The method as in claim 5 in which the step of adjusting the length of each basket line includes the step of positioning winches near the bottom of said mast and adjusting the length of said basket lines by means of said winches, each winch adjusting one line.

* * * * *